US005151109A

United States Patent [19]

Kitabayashi et al.

[11] Patent Number: 5,151,109

[45] Date of Patent: Sep. 29, 1992

[54] GRINDER AND METHOD OF MANUFACTURING THE SAME

[75] Inventors: Hiroyuki Kitabayashi, Neyagawa; Tadayuki Ishikawa, Hirakata, both of Japan

[73] Assignee: Kabushiki Kaisha Komatsu Seisakusho, Tokyo, Japan

[21] Appl. No.: 274,748

[22] Filed: Nov. 21, 1988

Related U.S. Application Data

[63] Continuation of Ser. No. 42,064, Apr. 24, 1987, abandoned.

[30] Foreign Application Priority Data

Apr. 28, 1986 [JP] Japan ..... 61-96883

[51] Int. Cl.[5] ..... B24D 18/00

[52] U.S. Cl. ..... 51/297; 51/207; 51/298

[58] Field of Search ..... 51/206 R, 207, 297, 51/401, 402, 293, 295, 298

[56] References Cited

U.S. PATENT DOCUMENTS

| | | | |
|---|---|---|---|
| 1,097,565 | 5/1914 | Straubel | 51/206 R |
| 2,705,194 | 3/1955 | St. Clair | 51/297 |
| 2,952,951 | 9/1960 | Simpson | 51/297 |
| 3,371,452 | 3/1968 | Mabey | 51/206 R |
| 3,631,638 | 1/1972 | Yoshikawa | 51/297 |
| 3,836,345 | 9/1974 | Graham | 51/297 |
| 4,536,195 | 8/1985 | Ishikawa | 51/293 |

FOREIGN PATENT DOCUMENTS 076965 1/1985 Japan .

*Primary Examiner*—Robert A. Rose
*Attorney, Agent, or Firm*—Varndell Legal Group

[57] ABSTRACT

A peripheral surface of an annular shaped grinder is distributed with grinding particles. The grinding particles have a particles distribution such that the spacing between the grinding particles in the axial direction is less than $\frac{2}{3}$ of the mean diameter of the particle and that the spacing between grinding particles in the circumferential direction is about 5–80 times of the mean particle diameter. The grinder is manufactured by a method of forming a pattern of an adhesive layer on a synthetic resin sheet, fixing the grinding particles to the patterns and laminating the sheets with fixed particles.

15 Claims, 7 Drawing Sheets

GRINDER AND METHOD OF MANUFACTURING THE SAME

This application is a continuation of application Ser. No. 042,064 filed Apr. 24, 1987, now abandoned.

BACKGROUND OF THE INVENTION

This invention relates a grinder and a method of manufacturing the same, and more particularly a grinder having a definite grinding particle distribution pattern on the surface of the grinder.

Since the development of a grinder made of cubic crystalline boron nitride (CBN), the request for improving the capability of the grinder has become increasing, especially;

(I) to eliminate as far as possible the random elements in the grinder for enabling quantitative determination and change the grinder performance and (II) to eliminate as far as possible not effective cutting edges, thereby producing inexpensive grinders of high performance.

As disclosed in Japanese Patent Application No. 15445 of 1985, the following method has been proposed for eliminating a random distribution of the grinding cutting edges which is considered as the greatest cause of the random performance of the grinder, thereby providing a grinder having a grinding particle distribution satisfying a definite rules.

According to this method, a pattern that determines the fixed position of the grinding particles is formed by an electroconductive layer on the surface of a sheet having a predetermined configuration, then the resin sheet formed with the pattern of the electroconductive layer is dipped in an electrolytic bath containing metal ions and incorporated with grinding particles, and the grinding particles are fixed on the pattern of the electroconductive layer by passing electric current between the electroconductive layer and a counter electrode. Then the resulting resin sheets secured with the grinding particles are laminated with a filler resin powder or a filler resin sheet interposed between the resin sheets and the laminated resin sheets are molded under pressure of an elevated temperature.

This method provides a grinder in which the grinding particles are distributed in a predetermined pattern on the surface of the grinder having higher grinding performance than the prior art grinder. In this grinder, however, the density of the grinding particle distribution, the condition of supplying a grinding liquid and the vibration produced at the time of grinding which are the principal causes that have an influence upon the grinding performance, are not controlled, thus failing to provide an excellent grinding performance. According to this method, although it is possible to ensure a grinding particle distribution according to a definite rule, since the pattern for securely fixing the grinding particles is formed by an electroconductive layer, it is necessary to use an expensive electroconductive ink for printing the pattern. Furthermore, it is necessary to print an insulator for preventing the grinding particles from adhering to the electroconductive layer for the purpose of improving the performance of the grinder. Thus this method requires two steps. Therefore, it is not only expensive but also difficult to prepare the pattern.

Moreover, since a long time is required for growing a plated film on the pattern, it takes a long time for securing the grinding particles to the pattern, thus prolonging the time for manufacturing the grinder. Moreover, as it is necessary to dip the resin sheet in a metal ion containing electrolytic bath, the components of the resin sheets are dissolved in the bath, thus degrading the same.

Since the grinding particles are secured to the pattern made up of an electroconductive layer by passing electric current, the grinding particles are limited to a non-electroconductive material. For this reason, where the nickel coated grinding particles are used, it is necessary to use the particles after recoating.

Where the line width of the pattern is narrow, it becomes easy to control the grain particle distribution. With this measure, however, the patterns becomes discontinuous, thus disenabling fixing of the grinding particles so that it is impossible to make extremely narrow the line width of the pattern. Thus, there is a limit for the control of the grinding particle distribution.

SUMMARY OF THE INVENTION

It is an object of this invention to provide an improved grinder having an excellent grinding capability and capable of eliminating the defects described above.

Another object of this invention is to provide a novel grinder that can be readily manufactured and the grinding particles distribution can be controlled readily.

A further object of this invention is to provide a method of manufacturing a grinder having an excellent grinding capability with relatively simple steps.

According to one aspect of this invention, there is provided a grinder having a grinding surface in which grinding particles are distributed, the grinding surface being constituted by the side surface of a rotary body rotatable about the axis of the grinder. The grinding particles are distributed in a substrate in a distribution pattern such that the spacing between grinding particles in the axial direction of the grinder is less than $\frac{2}{3}$ of the mean diameter of the grinding particles, and the spacing between the grinding particles in the circumferential direction of the grinder is about 5–80 times of the mean diameter.

According to another aspect of this invention, there is provided a method of manufacturing a grinder comprising the steps of forming a grinding particle fixing sheet of a predetermined configuration, forming an adhesive layer adapted to form a pattern of antiadhesive layer on the surface of the sheet, sprinkling grinding particles each having a predetermined diameter on the surface of the sheet for selectively fixing the grinding particles only on the pattern, laminating the sheets fixed with the grinding particles according to a predetermined lamination rule, and pressure molding a resulting lamination under a heated condition.

BRIEF DESCRIPTION OF THE DRAWINGS

In the accompanying drawings:

FIGS. 2*a* and 2*b* are partial enlarged views of the grinder shown in FIG. 1 wherein FIG. 2*b* shows the overlapping state of the grinding particles in the direction of rotation of the grinder;

DESCRIPTION OF THE PREFERRED EMBODIMENT

Figure 1:
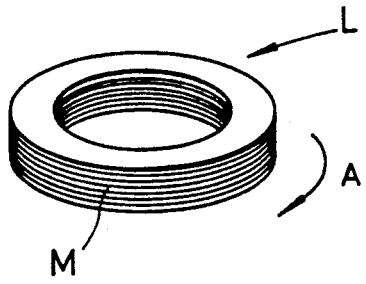
FIG. 1 is a perspective view showing one embodiment of the grinder according to this invention.
Figure 2:
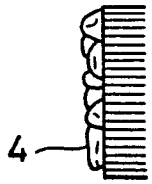
Figure 2:
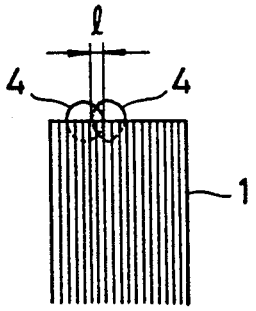
Figure 2:
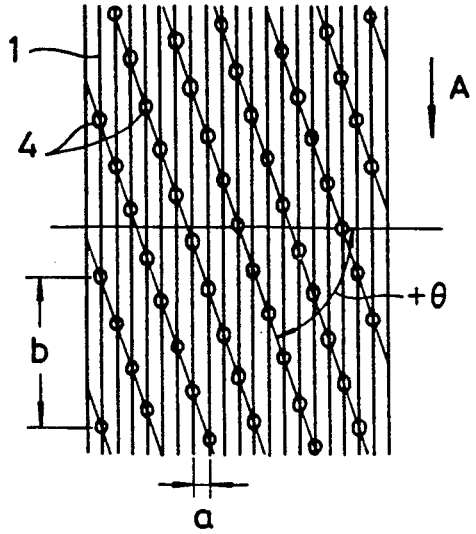

As shown in FIGS. 1, 2*b*, and 2*c*, the grinder shown in FIG. 1 is constituted by a lamination L in which grinding particles 4 having a grain size of 10D are distributed on a substrate made of a resin sheet such that the grinding particle spacing a in the axial direction of the grinder would be less than $10\times0.01$ mm, that the grinding particle spacing b in the circumferential direction would be 1 mm–10 mm (5–10 times of the mean particle diameter of the grinding particles used) and that the twist angle $\theta$ would be 30°. The term twist angle $\theta$ is used herein to mean the twisting angle of a train of the grinding particles with reference to the direction of rotation.

The grinder of this invention has a small coarseness of the finished surface. The grinding ratio is 250 when the grinder is used to grind steel designated by S45C, meaning a sufficiently large grinding capability.

Figure 3:
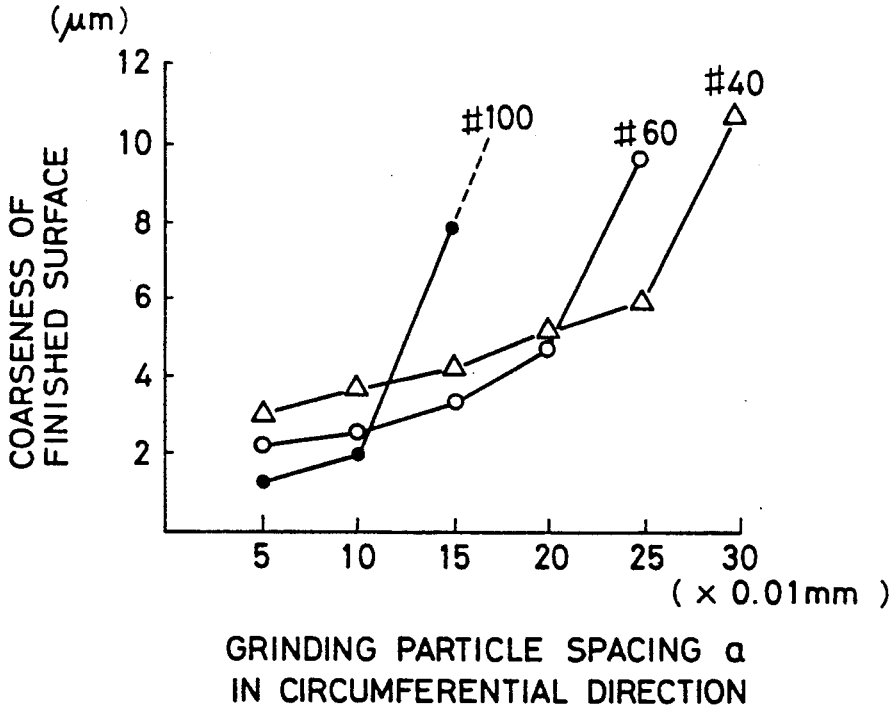
FIG. 3 is a graph showing the relationship between the grinding particle spacing along the axial direction of the grinder and the coarseness of the finished surface.

More particularly, the grinding particle spacing a in the axial direction of the grinder has the largest influence upon the coarseness of the finished surface. In order to provide a good finished surface, as shown in FIG. 2*c*, it is essential that the grinding particles 4 overlap with each other in the direction of rotation A of the grinder 1. The graph shown in FIG. 3 was obtained with reference to a grinder 1 utilizing grinding particles 4 respectively having grain sizes of #40, #60 and #100. As this graph shows the coarseness of the finished surface increases greatly from a point at which the grinding particle spacing a increases beyond $\frac{2}{3}$ of the mean particle diameter for each particle size. In the above, grain sizes (diameters) #100, #60 and #40 respectively correspond to 170–210 μm, 250–320 μm and 430–570 μm.

Since it is necessary that the amount l of the overlap of the grinding particles be larger than $\frac{1}{3}$ of the particle diameter, the spacing a between grinding particles in the axial direction of the grinder should be less than $\frac{2}{3}$ of the mean particle diameter.

The spacing b between grinding particles in the circumferential direction is directly related to the density of the particles and plays as an important factor for determining the cut depth, the chip length and grinding resistance of each grinding particle 4. Thus, the spacing b has a great influence upon the coarseness of the finished surface of a workpiece and the grinding ratio.

Figure 4:
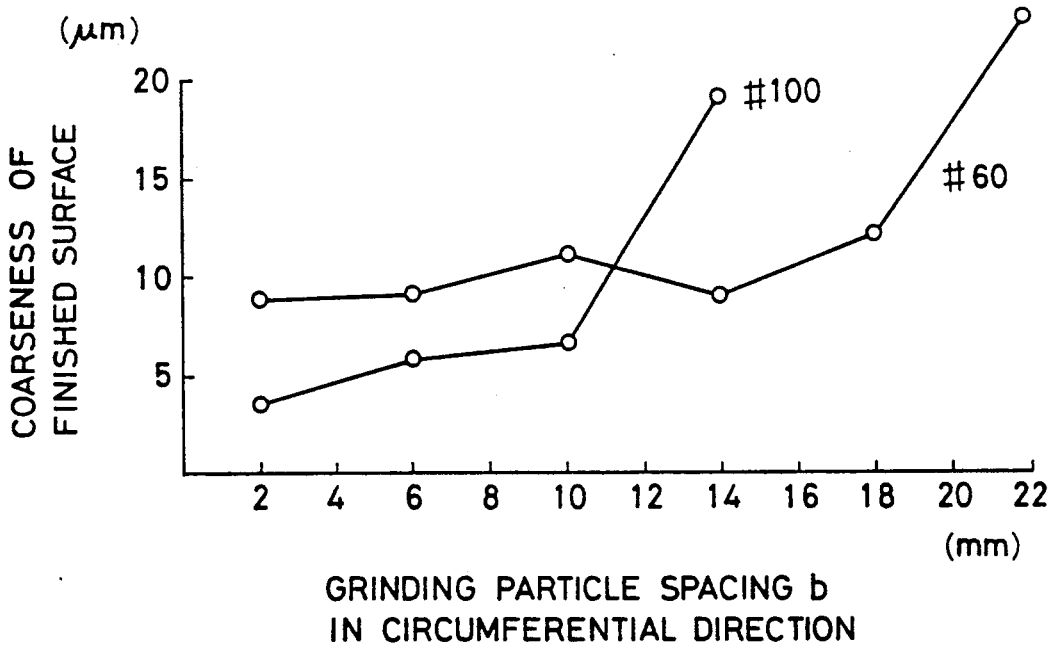
FIG. 4*a* and 4*b* are graphs showing the relationships among the grinding particle spacing in the circumferential direction, coarseness of the finished surface and the grinding ratio.
Figure 4:
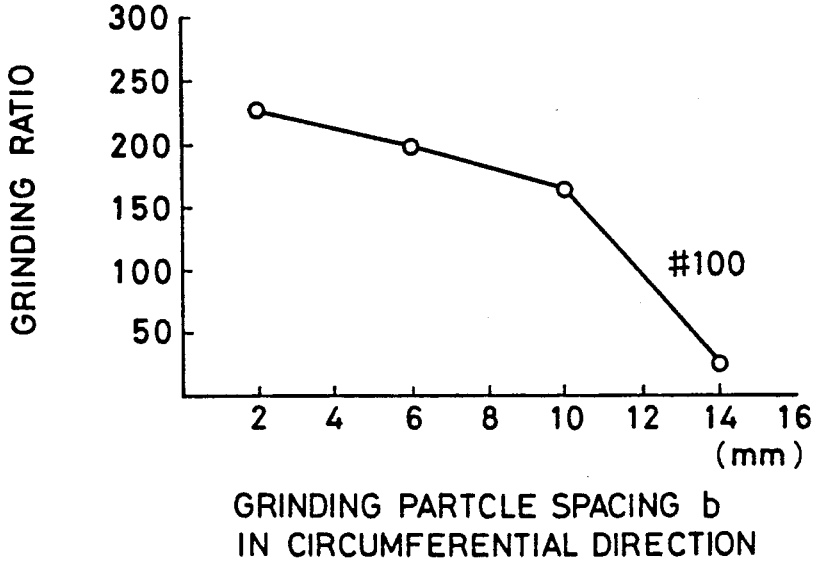

FIGS. 4*a* and 4*b* show the result of tests when the plane surface of a steel stock (S45C) was ground with a grinder 1 utilizing grinding particles 4 respectively having grain sizes #60 and #100. As can be noted from the graphs, the smaller the spacing b between the grinding particles in the circumferential direction is, the smaller the coarseness of the finished surface is, whereas the higher the grinding ratio is. Conversely, when the spacing b between the grinding particles in the circumferential direction exceeds 10 mm, the coarseness of the finished surface increases and at the same time, the grinding ratio decreased rapidly. From this, it can be understood that there is an upper limit for the particle spacing b. From the standpoint of the manufacturing cost, as the particle spacing b decreases, greater number of the grinding particles is necessary, thus increasing the cost.

From the foregoing description, it can be noted that, with the particle diameter of #100, the most efficient range of the particle spacing b is 1 mm–10 mm. Hence the optimum range of the particle spacing b is about 5–80 times of the mean particle diameter.

Figure 5:
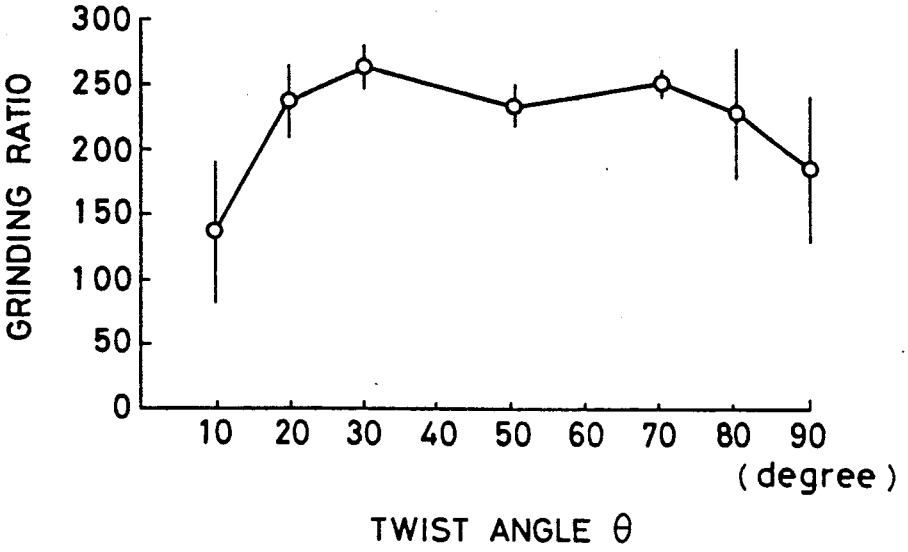
FIG. 5 is a graph showing the relationship between the twist angle and the grinding ratio.

The twist angle $\theta$ of the grinding particle train with reference to the direction of rotation of the grinder 1 has an influence upon the vibration caused by the grinding operation. For minimizing the vibration, it is necessary that the grinding particles 1*a* continuously contact the workpiece. To this end, it is essential that a plurality of grinding particle trains are juxtaposed at an angle $\theta$ in the width direction of the grinder 1 so that it is necessary to select the particle spacing b, twist angle $\theta$ and the width of the grinder for satisfying the conditions described above.

Where a grinding liquid is supplied to a ground point, the grinding ratio becomes different depending upon the twist angle $\theta$. FIG. 5 shows the relationship between the twist angle $\theta$ and the grinding ratio where a grinder 1 having a width of 10 mm and the particle spacing b of 4 mm was used. As can be noted from the graph, in a range wherein the twist angle $\theta$ is less than 10°, the grinding ratio is low and changes greatly because there is only one train of the grinding particles in the direction of the grinding. In a range wherein the twist angle $\theta$ is 20°–80°, a relatively high grinding ratio can be obtained, whereas near 90°, the spacing between the grinding particles becomes small, the supply of the grinding liquid to the ground point becomes difficult so that the grinding ratio varies greatly.

From the foregoing description, it can be noted that the twist angle $\theta$ should be determined such that a plurality of grinding particle trains present in the width direction of the grinder 1 and that the optimum range of the twist angle $\theta$ is from 15°–80°. The optimum ranges of various parameters are as follows.

(a) The spacing a between the grinding particles in the axial direction of the grinder should be less than $\frac{2}{3}$ of the mean particle diameter.

(b) The spacing b between the grinding particles in the circumferential direction should be about 5–80 times of the mean particle diameter.

(c) It is necessary to provide a plurality of grinding particle trains in the width direction of the grinder and to select the range of twist angle $\theta$ of the particle trains with reference to the direction of rotation to be 15°–80°.

It was noted that where the spacing a between grinding particle, in the axial direction of the grinder and the spacing b between particles in the circumferential direction are selected in the ranges described above, an efficient grinding performance could be obtained.

One example of the method of manufacturing the grinding of this invention will now be described.

Phenolic resin and a powder of SiC having a particle size of #1500 are admixed at a weight ratio of 1:1. Then a small amount of a solvent (toluene, methyl ketone) is added to the mixture. The resulting mixture is coated on a peel off paper and the coated mixture is treated with a doctor knife to obtain a coating of the mixture having a smooth surface. Then, the coated paper is dried at a temperature of 100°-150° C. for about 5 minutes. Then, the paper is peeled off to obtain a resin film. The resin film having a thickness of about 0.1 mm and containing 1-5% of residual solvent (shown in FIG. 6*a*) is cut to have an annulus configuration having an inner diameter of 150 mm and a radial thickness of 5 mm so as to obtain a resin sheet 1 utilized as a substrate.

Figure 6:
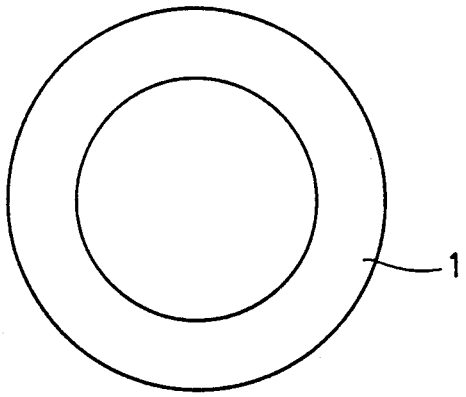
FIGS. 6*a* through 6*f* show successive steps of manufacturing the grinder shown in FIG. 1.
Figure 6:
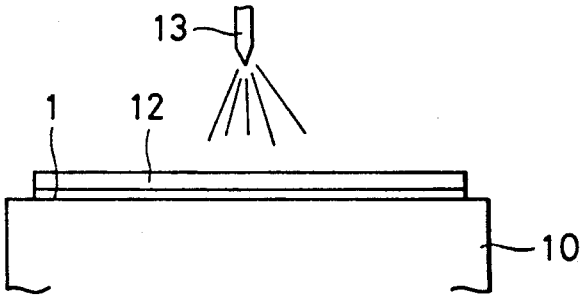
Figure 6:
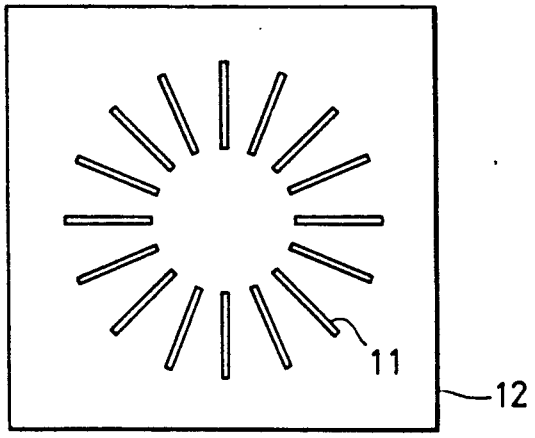
Figure 6:
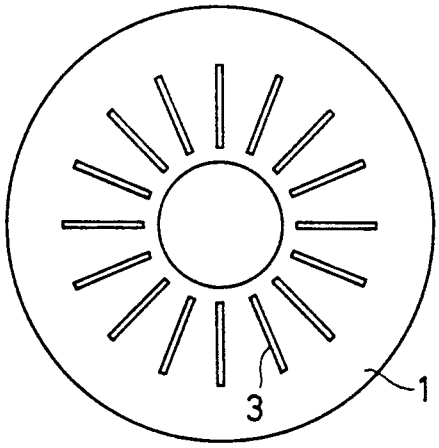
Figure 6:
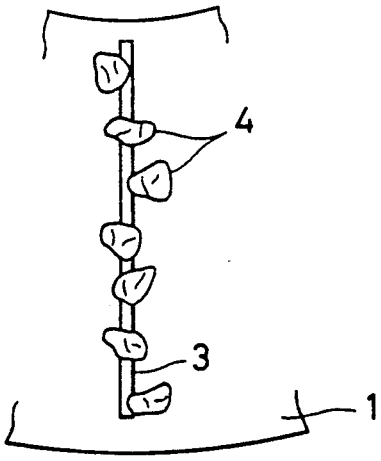
Figure 6:
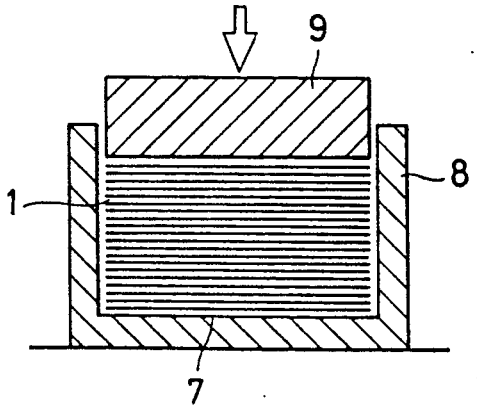
Figure 7:
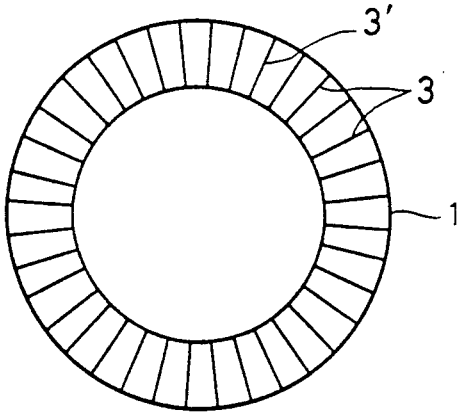
FIGS. 7*a*, 7*b* and 7*c* are plan views showing examples of various patterns of the adhesive layer formed on the surface of a resin sheet.
Figure 7:
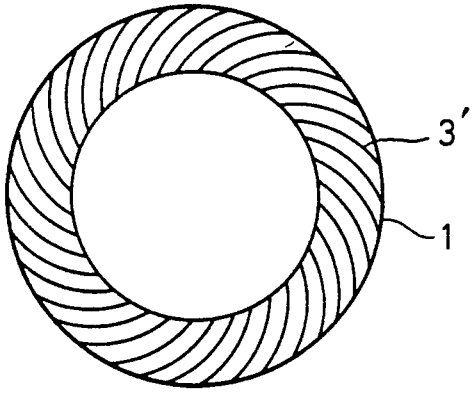
Figure 7:
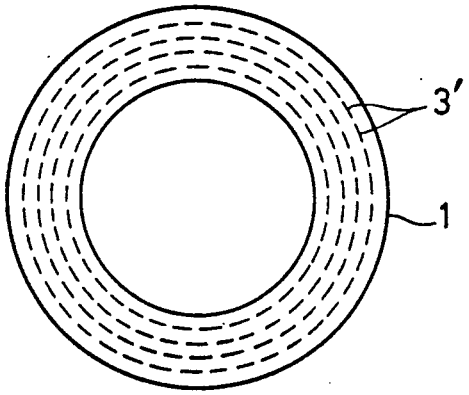

Then, as shown in FIG. 6*b*, the resin sheet 1 is mounted on a support 10 in the form of a magnetic chuck and a steel plate 12 stamped out a desired pattern as shown in FIG. 6*c* is mounted on the resin sheet 1 for clamping the same by the magnetic force of the magnetic chuck. Then, a liquid adhesive substance is sprayed onto the steel plate from a spray gun 13. Thereafter the steel plate 12 is removed to form a pattern 3 of the adhesive substance on the resin sheet. The liquid adhesive substance utilized in this embodiment is a synthetic rubber type cement manufactured by Sumitomo 3M Company in Japan and the steel plate 12 has a thickness of 0.2 mm. The line width of the pattern 3 can be controlled by the width of the grooves provided for the steel plate 12. The result of experiment shows that it is possible to control the line width to a minimum of 0.1 mm. With the line width of less than 0.1 mm, a portion of the grinding powder drops off at the time of fixing the grinding particles.

Then, the grinding particles are uniformly sprinkled on the surface of the resin sheet formed with the pattern of the adhesive substance. Then the grinding particles on the adhesive pattern are fixed, but those on the portions other than the pattern are blown off. Thus, as shown in FIG. 6*e*, a distributed pattern is obtained in which the grinding particles are fixed only on the pattern.

The bonding strength of the particles may be small enough to temporarily hold the particle at the predetermined position not to move at the time of lamination as will be described later. As is well known, the bonding strength is determined by the type of the adhesive, and its condition of use. In the case of the synthetic rubber type binder utilized in the spray gun described above, the highest strength can be obtained when the grinding particles are fixed after drying for about 20 seconds subsequent to the formation of the pattern, so that there is no trouble at the line of lamination to be described later.

Finally, as shown in FIG. 6*f*, resin sheets 1 fixed with the grinding particles 4 and resin sheets 7 acting as a filler are laminated in a metal mold 8 according to a predetermined rule of lamination while the particle distribution in the axial direction of the grinder is being controlled. Then, a high pressure is applied to the lamination thus formed through a press plate 9, and the lamination is maintained at a high temperature for a definite time. Although the molding condition varies depending upon the size (diameter and thickness) of the grinder being manufactured, usually a pressure of about 400 kg/cm$^2$ is applied and a temperature of about 150°-200° C. is applied for 30-120 minutes. During this interval, pressure is relieved for vent gas evolved from the resin. As a result of this pressure molding, a grinder is obtained in which various resin layers are integrated. A plurality of the resin sheets constitute the grinding particle layers of the resulting grinder. The patterns of the grinding particle adhesive layer form an one dimensional (the direction of rotation of the grinder) or a two dimensional (in the direction of rotation and the radial direction of the grinder) distribution. Further, the distribution of the grinding particles in the direction of lamination (in a flat grinder, in the axial direction) is determined by the method of lamination.

Although the contour of the lamination L is shown in FIG. 1, the outer peripheral surface M of the lamination L is actually used as the grinding surface. In order to improve the coarseness of the grinding surface, as shown in FIGS. 2*a* and 2*b*, the grinding particles should overlap with each other when the grinder surface is viewed in the direction of rotation of the grinder (in the direction of arrow A shown in FIG. 1).

According to the method of this invention, as the method of lamination of the resin sheets determines the grinding particle distribution in the axial direction of the grinder that governs the extent of overlapping of the grinder particles 4, the lamination should be carefully made. The grinding lamination thus formed is fitted on an aluminum body, not shown, to complete a grinder. In this manner, the grinder can be prepared very readily.

The grinder thus formed was used to grind a surface under conditions of: grinding speed: 1600 m/min, work speed: 10 m/min, and cut depth: 10 and 30 μm. The grinder thus formed has a satisfactory grinding performance.

It has been considered that a grinder has a random cutting edges distribution so that no concrete theory has been established regarding the cutting edge distribution. However, there are some papers regarding the distribution of the grinding particle contributing to the grinding, that is, the surface distribution of the effective grinding particles. According to Kazuo Nakayama's paper entitled "Relation between grinding and cutting", Investigation of Machine, Vol 23, No. 5, 1971, pages 174-, the percentage of the grinding particles on the surface of the grinder that contribute to actual grinding operation is only 2% of the total number of particles and remaining 98% particles are not effective. The most remarkable point is that the spacing between grinding particles in the circumferential direction and the spacing between configuous cutting edges amount to about 100 mm.

According to this invention, as the grinding particle distribution of a grinder can be controlled efficiently, ineffective cutting edges can be eliminated as far as possible, and the grinding efficiency can be greatly improved.

In the embodiment described above, the resin sheet had an annular configuration. However, the invention is not limited to such specific configuration.

As the resin for forming the resin sheets, various resins can be used as phenolic resin, epoxy resin, polyepoxy resin, etc. Although there is a problem of the surface coarseness, a nonwoven fabric can be used as a core when it is impregnated or coated with a resin. A metal sheet (metal bond grinder) can also be used. However, in the case of a resin shut utilizing nonwoven fabric as a core, particularly in the case of a commercially available thermoplastic film (type D3032 sold by Sony Chemical Co.), since this film is made of a core of a nonwoven fabric impregnated with a phenolic resin, its surface coarseness is about 40 μm. For this reason, where a pattern of the adhesive layer is to be depicted on the surface of the sheet, 0.3 mm is a limit for ensuring a stable pattern quality without breakage. Furthermore, there is a problem of appearance that certain number of fins are projected from the nonwoven fabric after the pressure molding. As will be discussed later, as the pattern or pattern lines become fine, the control of the grinding particle distribution becomes easy. However, the fineness of the pattern and pattern line is influenced by the surface coarseness of the resin sheet as above described. For this reason, it is desirable that the surface of the resin sheet is flat and smooth as far as possible.

The resin sheet acts as a binder of the grinding particles when subjected to a warm pressure molding to be described later. However, when the resin sheet is constituted by only resin, the resin has a tendency of flowing out from the metal mold at the time of warm pressure molding thereby making it difficult to effect satisfactory molding. Accordingly, for the purpose of improving the characteristics of the binder, for example, the wear resistant property and hardness, and for the purpose of preventing the flow out of the resin, it is advantageous to incorporate various additives to the resin. Various types of additives can be used. For example, such inorganic compounds as silicon carbide, boron carbide, alumina, selenium oxide and powders of such metals as copper, iron, etc. can be advantageously used. Especially silicon carbide is suitable because of its high hardness. When the particle size of the additive is too coarse, the additive severely precipitates in a resin liquid at the time of forming the sheet, thus failing to obtain a resin sheet of stable quality. For this reason, it is advantageous to use an additive having a particle size as small as possible. Where silicon carbide is used, particle size of less than #1500 is preferred for obtaining a resin sheet incorporated with SiC and having a stable quality. It is more advantageous to use an additive having a particle size of less than #2000.

The ratio of the additive to the resin is influenced by the type of the resin, the type of the additive, and the particle size are not always constant so that it is necessary to select a suitable range of the ratio by taking into consideration the property and moldabiltiy of the binder. Where a powder of SiC is added to a phenolic type resin, a weight ratio of about 1:1–1:3 is preferred.

The resin sheet can be formed by various methods. A Commercially available resin sheet can also be used to carry out the method of this invention. As has been pointed out before, the flatness of the surface of the resin sheet rolls has an important function at the time of forming the adhesive layer so that it is preferred to carefully use a method of forming a resin film having a smooth surface. In the embodiment described above, craft paper, grassing paper and resin coated paper which are treated with a silicon resin are used as the peel off paper.

Although in the foregoing embodiment, a spray gun was used for forming the pattern of the adhesive layer, another means such as a printing device can also be used. Furthermore, the pattern on the adhesive layer is not limited to that described above, and other patterns shown in FIGS. *7a* through *7c*, for example, can be used. The pattern is used to control the distribution of the grinding particles in the circumferential direction of the rotary grinder.

For example, in the pattern illustrated in FIG. *7a*, the grinding particles are arranged along fine radial lines 3' spaced at a definite distance in the circumferential direction, so that even when the resin sheets are randomly laminated, where the spacing between the radial lines is suitably selected, it is possible to control monodimension-alloy the grinding particle distribution.

In the pattern shown in FIG. *7b*, in addition to the distribution in the direction of rotation, the distribution in the radial direction is also taken into consideration, so that two dimensional can be realized. In the pattern shown in FIG. *7c*, the grinding particles are distributed in the rotary direction and radial direction, thus enabling two directional control of the particle distribution.

Factors that determines the two directional distribution of the grinding particles include the distribution in the rotational distribution, the distribution in the radial direction, and the thickness of the resin sheet. In other words, the particles distribute on the peripheral surface of the grinder with a definite spacing in the axial direction in accordance with the thickness (sum of the thickness of the particle fixing resin sheet and the thickness of the filler resin thickness) of the resin sheet.

Where only the particle fixing resin sheets are laminated, the spacing of the grinding particle distribution is too small. In addition, the supply of the binder (resin) is deficient so that it is advantageous to alternately laminate the particle fixing resin sheets and the filler resin sheets or a powder of the filler resin in the predetermined order.

By suitably combining the distribution of the grinding particles in the radial and rotational directions and the thickness of the resin sheet, the particle distribution can be controlled two dimensionally and when all factors described above are combined, three dimensional particle distribution can be controlled.

Factors that controls the three dimensional distribution include the angular positions of the particle fixing resin sheet layers at the time of lamination thereof in addition to the thickness of the resin sheet. More particularly, by rotating a little by little the particle fixing resin sheet at the time of laminating the same, the particle distribution in the direction of lamination (axial direction) can be controlled. Thus by adjusting the grinding particle distribution in the radial distribution on the surface of the particle fixing resin sheet, and the particle distributions in the rotational and laminating directions, it is possible to control the three dimensional particle distribution.

Figure 8:
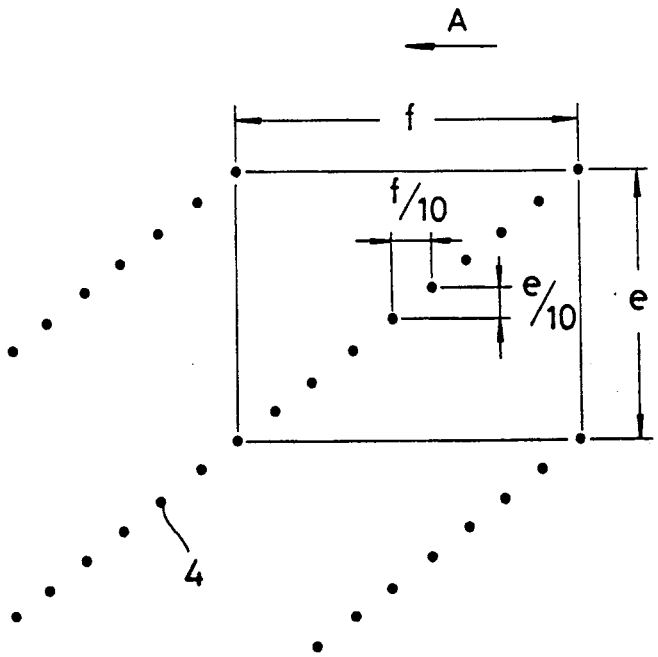
FIG. 8 is a diagrammatic representation showing one example of the grinding particle distribution on the grinding surface of the grinder.

As has been pointed out before, another example of the grain particle distribution on the peripheral surface of the grinder (grinding particle distributions in the rotational direction and the axial direction of the grinder) is diagrammatically shown in FIG. 8 in which arrow A shows the direction of rotation. It is found that the spacing (f) of less than 25 mm between the particles in the direction of rotation of the grinder and the particle spacing (e) of less than 1 mm in the axial direction are advantageous for improving the grinding performance. As above described, the spacing f can be controlled by the grinding grain distribution in the direction of rotation, whereas the spacing e can be controlled by the particle distribution in the direction of lamination (the angle of rotation of the particle resin sheets at the time of lamination thereof).

The method of this invention is applicable not only to such ultra hard grinding particles, as diamond and cubic crystalline boron nitride but also to such ordinary grinding particles as alumina and carborundum. The method of this invention cannot cope with the random characteristics of the cutting edge characteristic. However, when compared with an ordinary grinding particles, since the percentage of the grinding particles of the ultra hard grinding particles having a configuration caused by the atom structure as octahedral crystals is high, the random property is low. In the ultra hard particle grinder, the variation with time of the surface state of the grinding particles is negligibly small since the hardness of the particle is high and the wear is very small. For this reason, the method of this invention is most suitable for ultra hard grinding particles.

Since the method of manufacturing a grinder according to this invention comprises the steps of forming a sheet for fixing grinding particles and having a predetermined configuration, forming an adhesive layer adapted to form a pattern of an adhesive layer on the surface of the sheet, sprinkling grinding particles each having a predetermined diameter on the surface of the sheet for selectively fixing the grinding particles only on the pattern, laminating the sheets fixed with the grinding particles according to a predetermined lamination rule, and pressure molding the resulting lamination under a heated condition, it is possible to control as desired the grinding particle cutting edge distribution of the grinder which has been considered to have a random cutting edge distribution, thus enabling to obtain a grinder having any desired two dimensional distribution in the grinding surface of the grinder. Accordingly, in a grinder utilizing ultra hard grinding particles, it is possible to reduce not effective or inactive grinding particles which have increased the manufacturing cost. Moreover, it become possible to stabilize the grinder performance which could not be qualitatively grasped and changed.

What is claimed is:

1. A method of manufacturing a grinder comprising the steps of:

forming a grinding particle fixing sheet of a predetermined configuration;

forming an adhesive layer adapted to form a pattern of an adhesive layer on a surface of said sheet;

sprinkling grinding particles each having a predetermined diameter on a surface of said sheet for selectively fixing said grinding particles only on said pattern;

preparing a plurality of sheets fixed with said grinding particles produced by the above described steps; and laminating said sheets fixed with said grinding particles one over another according to a predetermined lamination rule, and pressure molding a resulting lamination under a heated condition.

2. The method according to claim 1 wherein said sheet is formed by the steps of:

admixing a powder of silicon carbide and a synthetic resin;

coating a resulting mixture on a peel off paper;

smoothing the coated mixture;

drying the assembly; and peeling off said peel off paper.

3. The method according to claim 1 wherein said adhesive layer is prepared by applying an adhesive onto a resin sheet through a mask having a predetermined pattern.

4. The method according to claim 1 wherein said adhesive layer is prepared by printing technique.

5. The method according to claim 1 wherein said lamination is produced by alternately laminating said grinding particle fixing sheet and a filler resin sheet in a predetermined order.

6. The method according to claim 5, wherein said pattern of adhesive layer is formed and said grinding particles are sprinkled on said pattern and fixed thereto and said sheets are laminated together with a spacing between said grinding particles in an axial direction of less than $\frac{2}{3}$ of the mean diameter of said grinding particles.

7. The method according to claim 1, wherein said pattern of adhesive layer is formed and said grinding particles are sprinkled on said pattern and fixed thereto with a spacing between said grinder particles in a circumferential direction of about 5–80 times a mean diameter of said grinding particles.

8. The method according to claim 6, wherein said pattern of adhesive layer is formed and said grinding particles are sprinkled on said pattern and fixed thereto with a spacing between said grinder particles in a circumferential direction of about 5–80 times a mean diameter of said grinding particles.

9. The method according to claim 1, wherein said pattern of adhesive layer is formed and said grinding particles are sprinkled on said pattern and fixed thereto with a twist angle $\theta$ of a twisting angle of a train of said grinding particles with respect to a diameter of rotation of said grinder of from 15° to 80°.

10. The method according to claim 8, wherein said pattern of adhesive layer is formed and said grinding particles are sprinkled on said pattern and fixed thereto with a twist angle $\theta$ of a twisting angle of a train of said grinding particles with respect to a diameter of rotation of said grinder of from 15° to 80°.

11. The method according to claim 1, wherein said grinding particles have a diameter greater than the width of said pattern of adhesive layer.

12. A method of manufacturing a grinder comprising the steps of:

forming a grinding particle fixing sheet of a predetermined configuration;

forming a patterned adhesive layer on a surface of said sheet;

sprinkling grinding particles each having a predetermined diameter on said surface on said sheet for selectively fixing said grinding particles only on said patterned adhesive;

removing grinding particles from nonadhesive areas on said surface on said sheet;

preparing a plurality of sheets fixed with said grinding particles produced by the above-described steps; and laminating said sheets having said grinding particles fixed thereto according to a predetermined laminating rule, and pressure molding a resultant lamination under heat.

13. The method according to claim 12, wherein the particles are removed from said non-adhesive portions of said surface of each of said sheets by blowing.

14. The method according to claim 13, wherein the grinding particles have a diameter greater than the width of the pattern of adhesive layer.

15. The method according to claim 14, wherein said pattern of adhesive is formed and said grinding particles are sprinkled on said pattern and fixed thereto and said sheets are laminated together with a spacing between said grinding particles in an axial direction of less than $\frac{2}{3}$ of the mean diameter of said grinding particles, wherein said pattern of adhesive layer is formed and said grinding particles are sprinkled on said pattern are fixed thereto with a spacing between said grinder particles in a circumferencial direction of about 5–80 times a mean diameter of said grinding particles, and wherein said pattern of adhesive layer is formed and said grinding particles are sprinkled on said pattern and fixed thereto with a twist angle $\theta$ of a twisting angle of a train of said grinding particles with respect to a diameter of rotation of said grinder of from 15° to 80°.

* * * * *